United States Patent [19]

Sunago et al.

[11] 4,116,815

[45] Sep. 26, 1978

[54] PROCESS FOR PREPARING NEEDLE COAL PITCH COKE

[75] Inventors: Hirofumi Sunago, Kitakyushu; Wataru Migitaka, Kawasaki, both of Japan

[73] Assignee: Nittetsu Chemical Industrial Co., Ltd., Tokyo, Japan

[21] Appl. No.: 808,775

[22] Filed: Jun. 21, 1977

[51] Int. Cl.[2] ..... C10G 9/14

[52] U.S. Cl. ..... 208/87; 208/131

[58] Field of Search ..... 208/131, 87

[56] References Cited

U.S. PATENT DOCUMENTS

| | | | |
|---|---|---|---|
| 2,775,549 | 12/1956 | Shea | 208/131 |
| 3,799,865 | 3/1974 | Suetsugu et al. | 208/131 |

FOREIGN PATENT DOCUMENTS

| | | | |
|---|---|---|---|
| 847,840 | 9/1960 | United Kingdom | 208/131 |

*Primary Examiner*—Herbert Levine

*Attorney, Agent, or Firm*—Wenderoth, Lind & Ponack

[57] ABSTRACT

A process for preparing needle coal pitch coke by mixing coal tar and/or coal tar pitch with aromatic and aliphatic solvents under atmospheric pressure and at temperatures between 15° C and 140° C. The mixing ratio of the aromatic and aliphatic solvents and their quantities of addition to coal tar and/or coal tar pitch are adjusted so that insoluble substances precipitate in a zone selected from the group consisting of a slurry zone and a crystal zone. By distilling a supernatant solution obtained by separating the insoluble substances occurring in the slurry or crystal zone, hydrocarbons consisting substantially of aromatic compounds and free of the insoluble substances are obtained. The obtained hydrocarbons are processed into coke.

15 Claims, 1 Drawing Figure

PROCESS FOR PREPARING NEEDLE COAL PITCH COKE

BACKGROUND OF THE INVENTION:

(A) FIELD OF THE INVENTION

For manufacturing artificial graphite electrodes for use in ultra-high-powered electric furnaces, anisotropic needle coke that can be readily graphitized is popularly used.

This invention relates to a process for preparing such needle coke. More particularly, it relates to a process for preparing needle coke by removing insoluble substances containing quinoline insoluble materials from coal tar and/or coal tar pitch.

(B) DESCRIPTION OF THE PRIOR ART

Various proposals have recently been made for the preparation of needle coke from such coal tar and/or coal tar pitch as contain quinoline insoluble materials, which have been thought to be unstable for the purpose, by removing undesirable insoluble components. For instance, one of such known processes comprises heat-treating coal tar pitch under a pressure between 0 and 10 kg/cm$^2$ and at a temperature between 350° and 390° C. Then, quinoline insoluble materials are filtered off through a 5 to 10 μm filter, at a temperature between the softening point of the pitch and 350° C. The resulting filtrate is processed into readily graphitizable needle coke. According to another known process, 100 parts of coal tar pitch is diluted with 50 parts of wash oil, by weight. Quinoline insoluble materials contained in the diluted coal tar pitch are filtered off by a vacuum rotary filter at 140° C. Then, the wash oil is separated from the refined pitch by vacuum distillation. The resulting refined pitch is processed into needle or linear shaped dry-distilled coke. However, these conventional processes involve great difficulties in processing large quantities of materials.

For instance, the separation of insoluble substances from a highly viscous mixture cannot be attained unless a large quantity of a solvent which has a high dissolving power is used. Even then, no great effect is achieved, since quinoline insoluble materials consist of very small grains dispersed or suspended in the pitch. Conversely, difficulty is encountered in disposing of the large quantity of solvent used.

Further, there are many problems that prevent efficient separation, such as filter clogging, difficulties in continuing centrifuge operation and in equipment maintenance due to splashing and adhesion of tacky substances. In addition, provision of a centrifuge and other large equipment leads to disadvantageously high cost. For these reasons, the conventionally proposed processes may be practiced on the laboratory scale, but are not advantageous on the industrial scale.

OBJECT AND SUMMARY OF THE INVENTION:

The object of this invention is to provide a process for removing quinoline insoluble materials from coal tar and/or coal tar pitch for the manufacture of needle coke.

To attain this process, the inventors have made various studies. As a consequence, it has now been found that insoluble substances precipitate when coal tar and/or coal tar pitch is mixed with aromatic and aliphatic solvents, and that the precipitated insoluble substances contain quinoline insoluble materials and other ingredients that are readily convertible to quinoline insoluble materials by heating, which are undesirable for the preparation of needle coal pitch coke.

The inventors also have found that, when coal tar and/or coal tar pitch is mixed with aromatic and aliphatic solvents, the insoluble substances precipitate in four modes, i.e., in a slurry, crystal, pitch and oily zone, as described later, depending on the mixing ratio among the aforesaid three constituents. It has accordingly been found that the insoluble substances can be precipitated either in the slurry, crystal or pitch zone by controlling the mixing ratio among coal tar and/or coal tar pitch, and aromatic and aliphatic solvents.

The insoluble substances occurring in the slurry zone settle by gravity at an average settling speed of 1/10 to 10 mm per minute (at 40° C.), whereas those occurring in the crystal zone settle at an average settling speed of 1/100 to 5 mm per minute (at 40° C.).

The insoluble substances precipitating in the crystal zone are plate- or flake-shaped materials like crystals of several millimeter, in length, those in the slurry zone are particles ranging between approximately 0.5 and 1 mm in size, and those in the pitch zone assume the form of pitch. In the oily zone, no insoluble substances precipitates, but oily sediment sometimes settles.

By suitably controlling the types and quantities of coal tar and/or coal tar pitch, and aromatic and aliphatic solvents to be mixed, the separation of insoluble substances in the slurry or crystal zone can be accomplished, not by use of such complex means as pressure filter and centrifuge, but by use of such simple means as gravity settling, liquid cyclone and filtration. According to this process, the raw material for the manufacture of needle coke can be obtained very advantageously on the industrial scale.

The process of this invention permits increasing the settling speed of the precipitated insoluble substances or their particle size, which consequently makes their separation very easy.

Since the insoluble substances precipitating in the slurry or crystal zone settle rapidly and are readily removable, the temperature at which their separation process is conducted need not be very high. That is, the temperature may be in the range of 15° to 140° C. This offers a great industrial merit.

In brief, the features of this invention are as follows:

(A) Coal tar and/or coal tar pitch, an aromatic solvent and an aliphatic solvent are mixed under atmospheric pressure and at a temperature between 15° and 140° C.

(B) The mixing ratio among the coal tar and/or coal tar pitch, and aromatic and aliphatic solvents is adjusted so that insoluble substances precipitate in the slurry or crystal zone.

(C) By distilling the supernatant obtained by separating the insoluble substances, hydrocarbons consisting substantially of aromatic compounds and free of quinoline insoluble materials are obtained. The obtained hydrocarbons are processed into needle coke.

Figure 1:
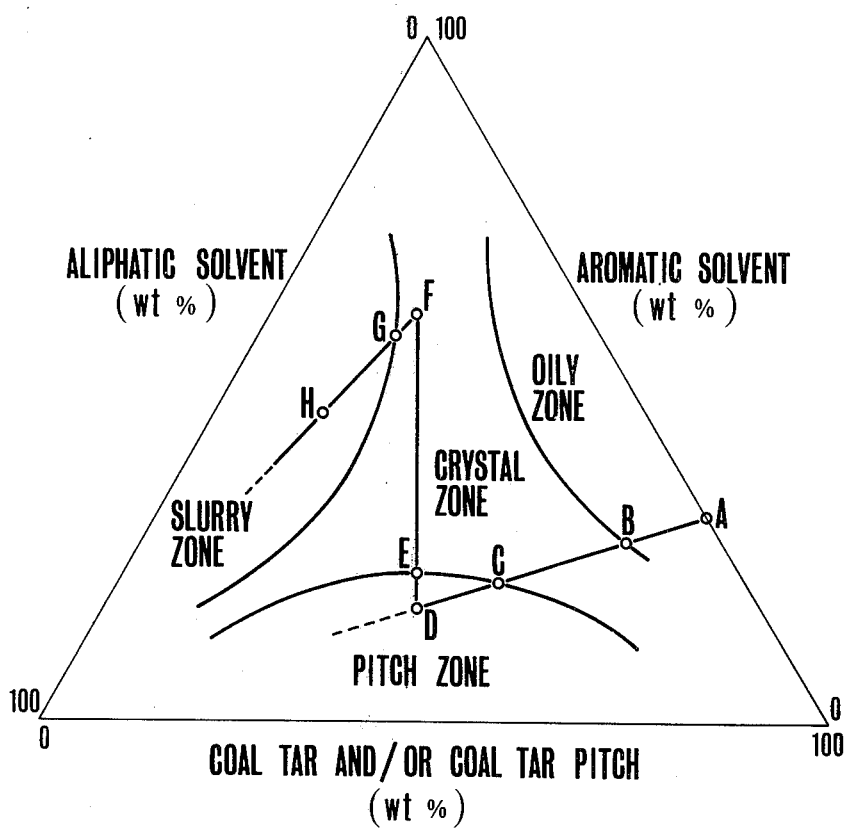
FIG. 1 shows the relation between the mixing ratio of solvents and the precipitation of insoluble substances.

DETAILED DESCRIPTION OF THE INVENTION:

Ordinary coal tar that occurs as a by-product in the dry distillation of coal serves the purpose of this invention. Coal tar pitch used in this invention is one that is obtained by cutting down light oils in coal tar by distillation. Cutback tar suitably blended with light oils may also be used. Of these materials, coal tar pitch is more preferable, especially soft coal tar pitch whose softening point (according to the R & B method) ranges between 20° and 40° C. and whose Conradson carbon residue ranges between 25 and 40 percent by weight.

Aromatic solvents used for this invention consist substantially of aromatic hydrocarbon and have initial boiling points of not lower than 80° C. and accomplish 95 percent by volume distillation at temperatures not higher than 400° C.

Aromatic solvents that have initial boiling points of not lower than 140° C. and accomplish 95 percent by volume distillation at temperatures not higher than 300° C. preferable. Those which have initial boiling points not lower than 140° C. and accomplish at least 60 percent by volume, or preferably at least 70 percent by volume, distillation at temperatures between 200° and 230° C., and 95 percent by volume distillation at temperatures not higher than 300° C. are most suitable. These solvents are essentially of aromatic hydrocarbons, such as benzene, toluene, xylene or their mixtures, and the fraction falling within said boiling point ranges, which is obtained from creosote oil, wash oil, anthracene oil and pitch oils obtained by ordinary coal tar distillation, and delayed coker oil obtained in the preparation of raw coal pitch coke according to the delayed coking process, and the mixture thereof can also be used.

Aliphatic solvents used for this invention are aliphatic hydrocarbons that have initial boiling points not lower than 30° C. and accomplish 90 percent by volume distillation at temperatures not higher than 350° C. For instance, n-hexane, industrial gasoline, petroleum naphtha, petroleum kerosene and gas oil can be used. Preferable aliphatic solvents have initial boiling points of not lower than 150° C. and accomplish 95 percent by volume distillation at temperatures not higher than 320° C. Those which have initial boiling points of not lower than 150° C. and accomplish 95 percent by volume distillation at temperatures not higher than 250° C., such as industrial gasoline, petroleum naphtha and petroleum kerosene falling within aforesaid boiling point range, are more preferable.

The process of this invention comprises the steps of mixing said aromatic and aliphatic solvents with coal tar and/or coal tar pitch at a temperature between 15° and 140° C., separating insoluble substances to be described later, distilling the supernatant obtained by removing the insoluble substances, and coking the distillation residue.

In mixing coal tar and/or coal tar pitch and the two solvents, coal tar and/or coal tar pitch may be added first with the aromatic solvent at a temperature between 15° and 140° C., preferably between 70° and 140° C., then with the aliphatic solvent. Or, the two solvents may be added to coal tar and/or coal tar pitch at the same time. In either case, generally, eventual precipitation of insoluble substances is not different. In adding the solvents, a predetermined temperature must be maintained. There is no need for pressurization, i.e. they may be added under atmospheric pressure. The mixing of coal tar and/or coal tar pitch with the solvents requires no special method, so far as a uniform mixture is obtained. The mixing time usually ranges between about 0.5 minute to 5 hours, though it varies with the stirring efficiency and other factors. When cutback tar is used as the starting material, the quantities of the solvents may be suitably adjusted since it contains more aromatic oil than ordinary tar does.

To insure uniform mixing and good precipitation of the insoluble substances, coal tar pitch and/or coal tar is mixed with the solvents at a temperature between 15° and 140° C., and preferably between 70° and 140° C. It is possible to mix at higher temperatures, but no particular benefit results. Conversely, high-temperature mixing generates much oil vapor.

FIG. 1 is a composition diagram showing the precipitation of the insoluble substances resulting from the mixing of coal tar and/or coal tar pitch with the solvents. The quantities of coal tar and/or coal tar pitch and the solvents affect the precipitation of the insoluble substances from their mixture. Their relationship will be explained by reference to the composition diagram in FIG. 1. Reference characters used in the following description correspond to respective compositional points in FIG. 1.

Coal tar and/or coal tar pitch and an aromatic solvent are mixed at a given temperature (point A). As an aliphatic solvent is slowly added to the mixture, plate or flake shaped crystalline insoluble substances start to precipitate at point B. On further adding the aliphatic solvent, the precipitated insoluble substances become viscous at point C. Then, black pitch-like substances settle at the vessel bottom at point D. Beyond point D, the condition of the insoluble substances remains unchanged even if the addition of the aliphatic solvent is continued. On adding the aromatic solvent to the composition at point D, viscous platecrystalline insoluble substances start to precipitate again at point E. On further adding the aromatic solvent, they change to non-viscous plate-crystalline insoluble substances (point F). On changing the solvent to aliphatic, the insoluble substances begin to become granular at point G, and are totally granulated at point H and thereafter.

By changing the solvents added, the insoluble substances precipitate in different conditions as described above. The region between points A and B is defined as the oily zone, because oily substances sometimes settle. The region between points B and C is defined as the crystal zone, because plate-crystalline substances precipitate. The region containing point D is defined as the pitch zone, since black pitch-like substances appear therein. As mentioned before, the region from point E through F to G becomes the crystal zone again. The region containing point H is called the slurry zone, since slurry insoluble substances precipitate in this area.

The boundaries between these zones can be determined clearly by carefully observing the condition of the insoluble substances. The plate-crystalline insoluble substances precipitating in the crystal zone reach several millimeters in length. The particles occurring in the slurry zone range between approximately 0.5 and 1 mm in diameter. The precipitates in the pitch zone are viscous, black, pitch-like substances collectively settling at the vessel bottom. Their softening points are usually higher than those of coal tar and/or coal tar pitch (by R & B method).

The ranges of the individual zones, in which the insoluble substances precipitate in varied forms according to the mixing ratios between coal tar and/or coal tar pitch and the solvents, change with the combination of solvents, as exemplified in Table 1.

Table 1.

Changes in Precipitating Insoluble Substances with

Table 1.-continued

Solvent Combinations and Ratios (Per cent by Weight)
(Example 1)

| Compositional Point | Soft Coal Tar Pitch | Benzene | n-hexane |
|---|---|---|---|
| A | 40 | 60 | 0 |
| B | 37 | 56 | 7 |
| C | 31 | 47 | 22 |
| D | 28 | 42 | 30 |
| F | 12 | 76 | 12 |
| G | 9 | 59 | 32 |

Note. Compositional points A, B, C,...., and G correspond to the compositional points A, B, C,...., and G in the description of FIG. 1.

(Example 2)

| Compositional Point | Soft Coal Tar Pitch | Wash Oil | Industrial Gasoline No. 4 |
|---|---|---|---|
| A | 60 | 40 | 0 |
| B | 43 | 29 | 28 |
| C | 41 | 27 | 32 |
| D | 25 | 16 | 59 |
| F | 14 | 54 | 32 |
| G | 11 | 42 | 47 |

Note 1. Compositional points A, B, C,...., and G correspond to the compositional points A, B, C,...., and G in the description of FIG. 1.
Note 2. Wash oil (obtained by distilling coal tar) Initial boiling point 191° C 60% by volume distillation 220° C 95% by volume distillation 290° C When such aromatic and aliphatic solvents as benzene and n-hexane, respectively, are combined, the crystal zone in FIG. 1 narrows toward the center, while the slurry and pitch zones expand.

Table 2.

Examples of Solvents Combined

| Aromatic Solvent | Aliphatic Solvent |
|---|---|
| Naphthalene oil | n-hexane |
| Naphthalene oil | Industrial gasoline |
| Naphthalene oil | Kerosene |
| Anthracene oil | n-hexane |
| Anthracene oil | Industrial gasoline |
| Anthracene oil | Kerosene |
| Wash oil | n-hexane |
| Wash oil | Industrial gasoline |
| Wash oil | Kerosene |

The different forms of insoluble substances can be selectively precipitated by adding to coal tar and/or coal tar pitch the aromatic and aliphatic solvents combined as shown in Table 2, and adjusting their mixing ratios as exemplified in Table 1, but the mixing ratio of this invention is not limited to those shown in Table 1.

By thus selecting the combinations and ratios of the solvents in conjunction with the ratio of coal tar and/or coal tar pitch, precipitation in the slurry or crystal zone can be attained. For this purpose, the use of both aromatic and aliphatic solvents is essential. It cannot be achieved by use of only an aliphatic solvent or an aromatic solvent.

The insoluble substances in these zones generally are large-sized. In the slurry zone, they settle at an average speed ranging between 1/10 and 10 mm per minute (at 40° C.). In the crystal zone, they settle at an average speed ranging between 1/100 and 5 mm per minute (at 40° C.).

As described above, the insoluble substances in the slurry and crystal zones precipitate in materially different manners as compared with those in other zones. Therefore, they can be separated with great ease. The precipitated insoluble substances can be separated by means of gravity settling, liquid cyclone, filtration, centrifugal separation or their combinations. Especially, liquid cyclone, filtration and gravity settling are preferable. The separating process requires no high temperature. It can be effected in such low-temperature ranges as 15° to 60° C., and preferably between 20° and 50° C. Conventionally, quinoline insoluble materials suspended in coal tar and/or coal tar pitch, usually smaller than 10 μm in diameter, have not been efficiently removable on the industrial scale by the aforementioned separating methods.

In the process according to this invention, the precipitated insoluble substances are not composed of only quinoline insoluble materials, but of high molecular weight matters which exist in coal tar and/or coal tar pitch. These insoluble substances are easy to separate, since they settle rapidly and are much larger than quinoline insoluble particles.

This invention offers a great industrial advantage by separating the insoluble substances in the crystal or slurry zone, preferbly in the former. The separated insoluble substances are blackish-brown plate crystals or particles. In separation, some excess solvents may mix with the insoluble substances, in the form of supernatant. If required, they may be removed by an ordinary method.

It is preferable that the solvents used are separated, independently or in combination, from the supernatant after the aforesaid separating process by distillation at atmospheric or reduced pressure. The solvents distilled away may be reused. In this distillation process, some of light ingredients contained in the coal tar and/or coal tar pitch are distilled away with the solvents. To simplify this process, it is preferable to limit the temperatures at which the aromatic and aliphatic solvents accomplish 95 percent by volume distillation to not higher than 300° and 250° C., respectively.

This distillation process may be omitted. The supernatant resulting from the insoluble substance separating process may then be used as the material for the delayed-coking process. The solvents will be recovered in the distilling tower always employed in the delayed-coking process.

Raw coke is obtained from (the resulting coal tar and/or coal tar pitch) by the ordinary coking process, and preferably by the delayed-coking process. By calcining the obtained raw coke, readily graphitizable needle coke is prepared. To facilitate the understanding of this invention, the following examples are given, but they should not be considered as limiting the scope of this invention.

EXAMPLE 1

One part by weight of soft coal tar pitch, having the softening point of 23° C. (by R & B method) and containing 7.9 percent by weight toluene insoluble materials and 2.2 percent by weight quinoline insoluble materials, was mixed with 4 parts by weight of benzene and 5 parts by weight of n-hexane. The mixture was stirred at 100° C. and allowed to cool to 40° C., as a consequence of which the insoluble substance precipitated in the slurry zone. The precipitated insoluble substance ranged between approximately 0.5 and 1 mm in size and was brown in color. The insoluble substance was separated by gravity settling. The resulting supernantant was distilled under a reduced pressure of 100 torr. The material thus obtained had the softening point of 23° C. and contained 2.6 percent by weight toluene insoluble materials and traces of quinoline insoluble materials. By coking the adjusted material in an autoclave at 2.5 kg/cm$^2$, raw coke with well developed flow structure was obtained in a yield of 46 percent by weight against the starting material soft coal tar pitch. The product coke, obtained by graphitizing at 2800° C. after calcining the raw coke, exhibited a coefficient of thermal expansion of $0.8 \times 10^{-6}$/degree, and Co of 6.716 A.

Note. Co = mean unit — cell length measured by x-ray diffraction

EXAMPLE 2

Three parts by weight of the same soft coal tar pitch as used in the preceding example was mixed with one part by weight of wash oil (of the type shown in Example 2 of Table 1). The mixture was stirred at 80° C., then mixed with one part by weight of industrial gasoline No. 4 (JIS K2201) and allowed to cool to 40° C. The precipitated insoluble substance was plate-crystals, ranging between 2 and 3 mm in length. The insoluble substance was filtered with a 0.149 mm screen. The resulting filtrate was distilled at a reduced pressure of 100 torr. An adjusted material having the softening point of 23° C. (by R & B method) and containing 5.2 percent by weight toluene insoluble materials and traces of quinoline insoluble materials was obtained. By carbonizing under the same conditions as in Example 1, raw coke with developed flow structure was obtained in a yield of 51 percent by weight against the starting material soft coal tar pitch. The raw coke was calcined and then graphitized at 2800° C., and the graphitized coke exhibited a coefficient of thermal expansion of $0.9 \times 10^{-6}$/degree, and Co of 6.720 A.

COMPARATIVE EXAMPLE

Raw coke was prepared by coking the same soft coal tar pitch as used in the above-described examples under the same conditions except for the solvent processing according to this invention. The soft coal tar pitch used in this case was not treated with aromatic and aliphatic solvents. The yield against the raw material was 56 percent by weight, but no flow structure was observed. The product graphitized at 2800° C. exhibited a coefficient of thermal expansion of $1.9 \times 10^{-6}$/degree, and Co of 6.738 A.

What is claimed is:

1. A process for preparing needle coke which comprises mixing (1) coal tar, coal tar pitch or a mixture thereof with (2) an aromatic solvent and (3) an aliphatic solvent at atmospheric pressure and a temperature between 15° and 140° C., the mixing ratio among the aromatic solvent, the aliphatic solvent and the coal tar, coal tar pitch or mixture thereof being adjusted so that quinoline insoluble substances precipitate in a zone selected from the group consisting of a slurry zone and a crystal zone, separating the precipitated substances from the resultant mixture to obtain a supernatant, distilling the supernantant to obtain, as a distillation residue, hydrocarbons consisting substantially of aromatic compounds, said hydrocarbons being substantially free of quinoline insoluble substances, and coking the distillation residue to produce coke.

2. A process according to claim 1, wherein said coal tar pitch is used, and is a soft coal tar pitch.

3. A process according to claim 1, wherein said aromatic solvent is at least one member selected from the group consisting of creosote oil, wash oil and anthracene oil.

4. A process according to claim 1, wherein said aromatic solvent is delayed coker by-product oil obtained when preparing raw coal pitch coke.

5. A process according to claim 1, wherein said aromatic solvent has an initial boiling point of not lower than 80° C. and accomplishes 95 percent by volume distillation at temperatures not higher than 400° C.

6. A process according to claim 1, wherein said aromatic solvent has an initial boiling point of not lower than 140° C. and accomplishes at least 95 percent by volume distillation at temperatures not higher than 300° C.

7. A process according to claim 1, wherein said aromatic solvent has an initial boiling point of not lower than 140° C. and accomplishes at least 60 percent by volume distillation at temperatures between 200° and 230° C., and 95 percent by volume distillation at temperatures not higher than 300° C.

8. A process according to claim 1, wherein said aliphatic solvent is at least one member selected from the group consisting of industrial gasoline, naphtha and kerosene.

9. A process according to claim 1, wherein said aliphatic solvent has an initial boiling point of not lower than 30° C. and accomplishes 90 percent by volume distillation at temperatures not higher than 350° C.

10. A process according to claim 1, wherein said aliphatic solvent has an initial boiling point of not lower than 150° C. and accomplishes 95 percent by volume distillation at temperatures not higher than 320° C.

11. A process acording to claim 1, wherein said aliphatic solvent has an initial boiling point of not lower than 150° C. and accomplishes 95 percent by volume distillation at temperatures not higher than 250° C.

12. A process according to claim 1, wherein the mixing temperature is in the range from 70° to 140° C.

13. A process according to claim 1, wherein said separating temperature is in the range from 20° to 50° C.

14. A process according to claim 1, wherein said separating is carried out by means of Gravity settling, Liquid cyclone or Filtration.

15. A process according to claim 1, whereing the coking is effected by the delayed coking process.

* * * * *